US009989896B2

(12) United States Patent
Kikuchi et al.

(10) Patent No.: US 9,989,896 B2
(45) Date of Patent: Jun. 5, 2018

(54) FIXING DEVICE, IMAGE FORMING APPARATUS, AND METHOD FOR ADJUSTING LENGTH OF INTERPOSING AND PRESSURIZING REGION BY FIXING DEVICE

(71) Applicants: KABUSHIKI KAISHA TOSHIBA, Tokyo (JP); TOSHIBA TEC KABUSHIKI KAISHA, Toyko (JP)

(72) Inventors: Kazuhiko Kikuchi, Yokohama Kanagawa (JP); Osamu Takagi, Tokyo (JP); Chie Miyauchi, Odawara Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/624,568

(22) Filed: Jun. 15, 2017

(65) Prior Publication Data

US 2017/0363996 A1 Dec. 21, 2017

(30) Foreign Application Priority Data

Jun. 20, 2016 (JP) ..... 2016-121405
Mar. 24, 2017 (JP) ..... 2017-058813

(51) Int. Cl.
*G03G 15/20* (2006.01)

(52) U.S. Cl.
CPC ..... *G03G 15/2017* (2013.01)

(58) Field of Classification Search
CPC ..... G03G 15/2017; G03G 15/2028; G03G 15/2053; G03G 15/2064; G03G 15/2078; G03G 15/2089
See application file for complete search history.

(56) References Cited

U.S. PATENT DOCUMENTS 5,171,969 A 12/1992 Nishimura et al.
5,367,369 A * 11/1994 Nakai ..... G03G 15/2046 219/216

(Continued)

FOREIGN PATENT DOCUMENTS

JP 2005-114959 4/2005

OTHER PUBLICATIONS

Extended European Search Report dated Nov. 16, 2017, filed in counterpart European Patent Application No. 17176312.1 (10 pages).

*Primary Examiner* — Hoang Ngo
(74) *Attorney, Agent, or Firm* — Patterson & Sheridan, LLP

(57) ABSTRACT

In general, a fixing device according to an embodiment includes an endless belt, a pressure element, a heating member, an adjustment mechanism, and a controller. The pressure element conveys a sheet while interposing the sheet under pressure between the same and the endless belt. The heating member is provided on the inner side of the endless belt and has a heat generating element for heating the endless belt. The adjustment mechanism moves at least one of the heating member and the pressure element in such a direction as to bring the one closer to or away from the other, to adjust the nip width which is the length of an interposing and pressurizing region in a sheet conveyance direction, the interposing and pressurizing region being formed by the heating member and the pressure element to interpose the endless belt under pressure. The controller controls the adjustment mechanism so that A>B≥N is satisfied, where A is the nip width during a fixing process in which the sheet is heated to fix a color material onto the sheet, B is the nip width during temperature raising of the heating member to be conducted before the fixing process, and N is the length (Continued)

of the heat generating element in the sheet conveyance direction.

10 Claims, 8 Drawing Sheets

(56) References Cited

U.S. PATENT DOCUMENTS

| | | | | |
|---|---|---|---|---|
| 6,078,781 | A | 6/2000 | Takagi et al. | |
| 9,261,832 | B2 | 2/2016 | Muramatsu et al. | |
| 9,411,276 | B2 | 8/2016 | Takagi | |
| 2011/0268460 | A1 | 11/2011 | Odate | |
| 2013/0004218 | A1 | 1/2013 | Tsueda et al. | |
| 2014/0186077 | A1* | 7/2014 | Lee ..... | G03G 15/2017 399/329 |
| 2015/0331372 | A1 | 11/2015 | Takagi | |
| 2015/0331376 | A1 | 11/2015 | Shimmura et al. | |

* cited by examiner (A)

(B)

(A)

(B)

FIXING DEVICE, IMAGE FORMING APPARATUS, AND METHOD FOR ADJUSTING LENGTH OF INTERPOSING AND PRESSURIZING REGION BY FIXING DEVICE

CROSS-REFERENCE TO RELATED APPLICATION

This application is also based upon and claims the benefit of priority from Japanese Patent Application No, 2016-121405, filed on Jun. 20, 2016 and Japanese Patent Application No, 2017-058813, filed on Mar. 24, 2017; the entire contents of which are incorporated herein by reference.

FIELD

Embodiments described herein relate generally to a technique for fixing a toner image formed on a sheet onto the sheet.

BACKGROUND

Conventionally known is a fixing device for heating a sheet using a plate-shaped heat generating member. This fixing device is configured such that the surfaces of the plate-shaped heat generating member and a pressure roller face each other. This fixing device is configured such that the plate-shaped heat generating member is in contact with the inner surface of an endless belt and the opposite surface of the endless belt is in contact with a first surface of a sheet, thereby heating the sheet via the endless belt. This fixing device is also configured such that the pressure roller and the second surface of the sheet are in contact with each other, allowing the plate-shaped heat generating member and the pressure roller to produce pressure. This allows the fixing device to fix a toner image transferred to the sheet onto the sheet.

The endless belt is in contact with the pressure roller. When the pressure roller has a high heat capacity, the heat for heating the endless belt is taken away by the pressure roller, and at warm-up or when returning from sleep, this will cause a delay corresponding thereto in reaching a specified temperature. In this context, for example, it is conceivable that during temperature raising such as at the time of warm-up, the pressure roller is separated from the endless belt to eliminate the path through which heat escapes to the pressure roller, thereby improving the performance of temperature raising of the fixing device.

However, in this case, the contact region of the endless belt with the heat generating member may be excessively heated, thus possibly accelerating the speed of deterioration of the endless belt.

DETAILED DESCRIPTION

Figure 1:
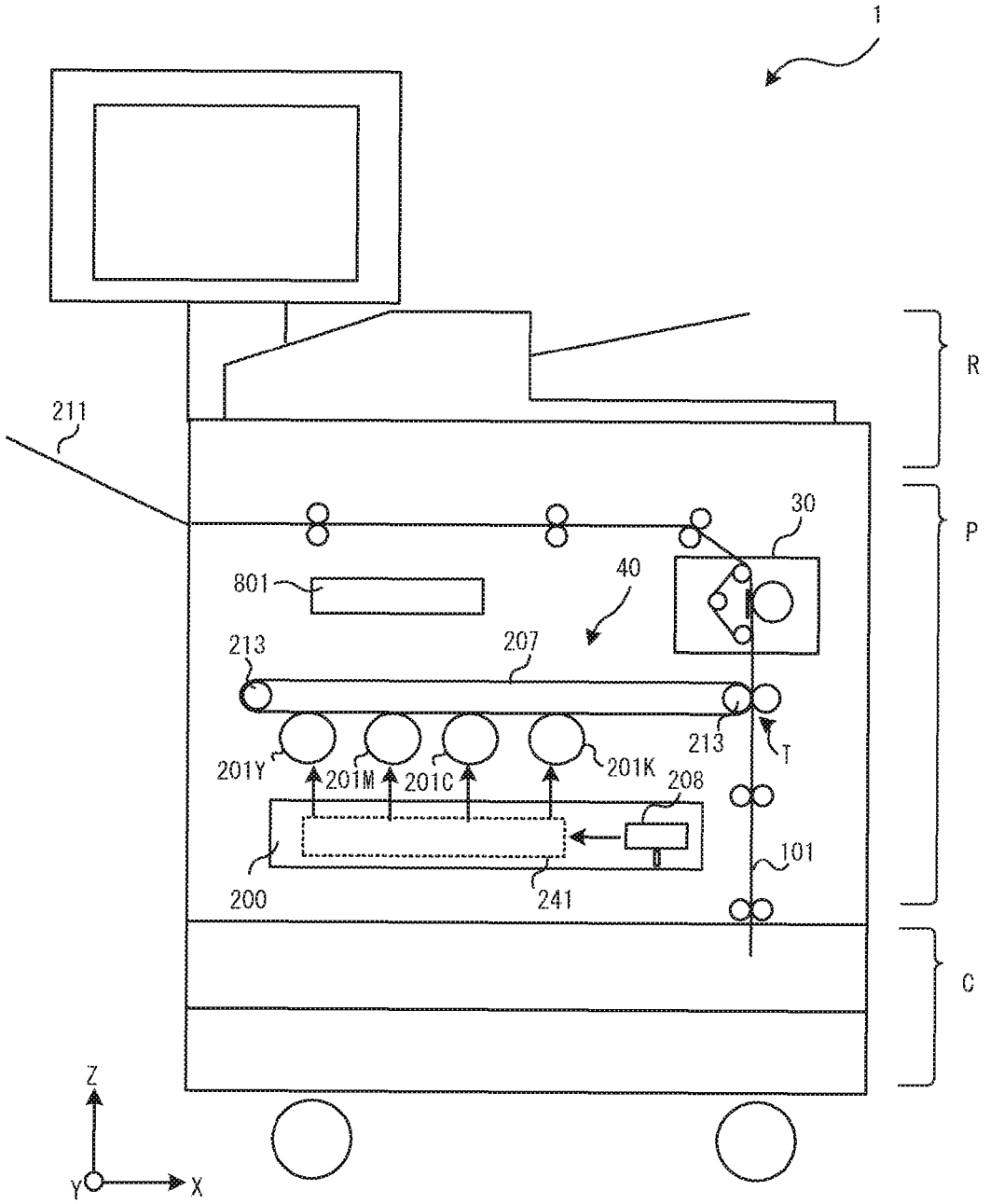
FIG. 1 is a diagram schematically illustrating an image forming apparatus according to an embodiment.

A fixing device according to an embodiment generally includes an endless belt, a pressure element, a heating member, an adjustment mechanism, and a controller. The pressure element conveys a sheet while interposing the sheet under pressure between the pressure element and the endless belt. The heating member is provided on the inner side of the endless belt and has a heat generating element for heating the endless belt. The adjustment mechanism moves at least one of the heating member and the pressure element in such a direction as to bring the one closer to or away from the other, and adjusts the nip width which is the length of an interposing and pressurizing region in a sheet conveyance direction, the interposing and pressurizing region being formed by the heating member and the pressure element to interpose the endless belt under pressure. The controller controls the adjustment mechanism so that $A>B\geq N$ is satisfied, where A is the nip width during a fixing process in which the sheet is heated to fix a toner image onto the sheet, B is the nip width during temperature raising of the heating member to be conducted before the fixing process, and N is the length of the heat generating element in the sheet conveyance direction.

In general, an image forming apparatus according to an embodiment includes a transfer unit and a fixing device. The transfer unit transfers an image to be formed onto a sheet. The fixing device performs a fixing process for fixing the image transferred to the sheet onto the sheet. The fixing device includes: an endless belt; a pressure element for conveying a sheet while interposing the sheet under pressure between the pressure element and the endless belt; a heating member provided on the inner side of the endless belt and having a heat generating element for heating the endless belt; an adjustment mechanism which moves at least one of the heating member and the pressure element in such a direction as to bring the one closer to or away from the other and adjusts the nip width which is the length of an interposing and pressurizing region in a sheet conveyance direction, the interposing and pressurizing region being formed by the heating member and the pressure element to interpose the endless belt under pressure; and a controller for controlling the adjustment mechanism so that $A>B\geq N$ is satisfied, where A is the nip width during the fixing process in which the sheet is heated to fix a toner image onto the sheet, B is the nip width during temperature raising of the heating member to be conducted before the fixing process, and N is the length of the heat generating element in the sheet conveyance direction.

In general, a method for adjusting the length of an interposing and pressurizing region by a fixing device according to an embodiment is to adjust the nip width or the length of an interposing and pressurizing region in a sheet conveyance direction by the fixing device having the interposing and pressurizing region which is formed by a heating member and a pressure element so as to interpose an endless belt under pressure. Here, the fixing device includes: the endless belt; the pressure element for conveying a sheet while interposing the sheet under pressure between the pressure element and the endless belt; and the heating member provided on the inner side of the endless belt and having a heat generating element for heating the endless belt. In this method, during temperature raising of the heating member to be conducted before a fixing process in which the sheet is heated to fix a toner image onto the sheet, at least one of the heating member and the pressure element is moved in such a direction as to bring the one closer to or away from the other so that A>B≥N is satisfied where A is the nip width during the fixing process, B is the nip width during the temperature raising, and N is the length of the heat generating element in the sheet conveyance direction.

An image forming apparatus and a fixing device according to an embodiment will now be described below with reference to the drawings.

First Embodiment

FIG. 1 is a schematic diagram illustrating an image forming apparatus according to an embodiment. The image forming apparatus 1 has a reading unit R, an image forming unit P, and a paper cassette unit C. The reading unit R reads a document sheet placed on a platen by a CCD (Charge-Coupled Device) image sensor to thereby convert an optical signal into digital data. The image forming unit P acquires a document image read in the reading unit R or print data from an external personal computer, and forms and fixes a toner image on a sheet.

The image forming unit P has a laser scanning section 200, and photoconductor drums 201Y, 201M, 201C, and 201K. The laser scanning section 200 has a polygon mirror 208 and an optical system 241. On the basis of image signals for colors of yellow (Y), magenta (M), cyan (C), and black (K), the laser scanning section 200 irradiates the photoconductor drums 201Y to 201K to provide an image to be formed on the sheet.

The photoconductor drums 201Y to 201K retain respective color toners supplied from a developing device (not shown) corresponding to the aforementioned irradiation locations. The photoconductor drums 201Y to 201K sequentially transfer the toner images being held onto a transfer belt 207. The transfer belt 207, which is an endless belt, is rotationally driven by a roller 213 to convey the toner image to a transfer location T.

A conveyance path 101 conveys a sheet stocked in the paper cassette unit C through the transfer location T, a fixing device 30, and an output tray 211 in this order. The sheet stocked in the paper cassette unit C is guided by the conveyance path 101 and conveyed to the transfer location T, and then the transfer belt 207 transfers the toner image to the sheet at the transfer location T.

The sheet having the toner image formed on a surface thereof is guided by the conveyance path 101 and conveyed to the fixing device 30. The fixing device 30 heats and melts the toner image to thereby allow the toner to be penetrated into and fixed onto the sheet. This can prevent the toner image on the sheet from being disturbed by an external force. The conveyance path 101 conveys the sheet on which the toner image is fixed to the output tray 211 so as to eject the sheet out of the image forming apparatus 1.

A controller 801 is a unit for controlling devices and mechanisms in the image forming apparatus 1 in a centralized manner.

A configuration including the sections used for conveying an image (toner image) to be formed to the transfer location T and transferring the image onto the sheet is referred to as a transfer unit 40. The transfer unit 40 transfers the image to be formed (the toner image on the transfer belt 207) onto the sheet.

Figure 2:
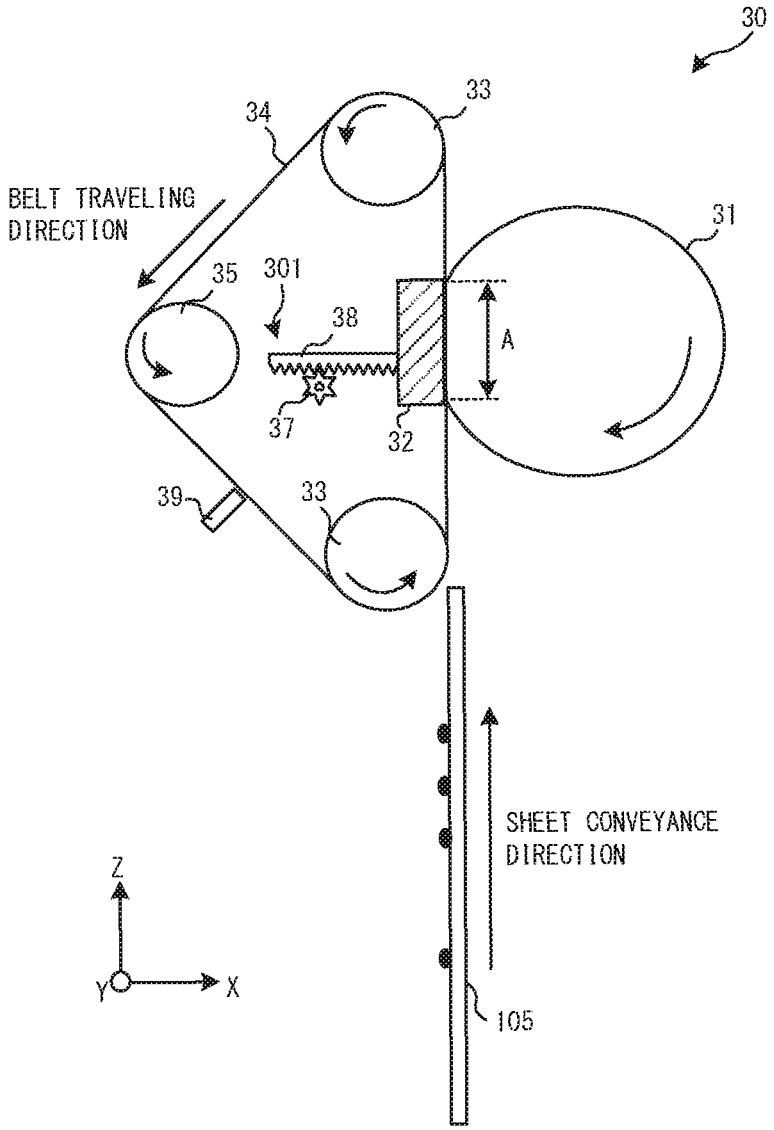
FIG. 2 is a diagram illustrating a configuration of a fixing device according to an embodiment.

FIG. 2 is a diagram illustrating a configuration example of the fixing device 30. The fixing device 30 performs a fixing process for fixing an image transferred to a sheet onto the sheet. The fixing device 30 has a plate-shaped heating member 32, and an endless belt 34 suspended by a plurality of rollers. The endless belt 34 is to be a member including an elastic layer (for example, Si rubber). However, the material is shown only by way of example. Furthermore, the fixing device 30 has rollers 33 and 35 by which the endless belt 34 is suspended and which rotate the endless belt 34 in a certain direction. The fixing device 30 also has a pressure roller 31 (a pressure element) with a surface having an elastic layer formed thereon. During the fixing process, the pressure roller 31 conveys the sheet while interposing the sheet under pressure between the pressure roller 31 and the endless belt 34. The pressure roller 31 is rotated, thereby causing the endless belt 34 to be driven and rotated in a direction opposite to the rotation of the pressure roller 31.

The heating member 32 at its heat-generation side is in contact with the inner surface of the endless belt 34 and presses the endless belt 34 against the pressure roller 31. This configuration allows the heating member 32 and the pressure roller 31 to interpose, heat, and pressurize a sheet 105, which is conveyed to the contact portion (nip portion) formed between the heating member 32 and the pressure roller 31 and which carries a toner image. The heating member 32 is in contact with the inner surface of the endless belt 34 and heats the endless belt 34 while the endless belt 34 is being pushed against the pressure roller 31. As will be discussed later, the heating member 32 has a heat generating resistive member 60 (heat generating element) therein. Before the fixing process, the heat generating resistive member 60 performs the temperature raising for raising the temperature of the heating member 32.

The fixing device 30 has a nip adjustment mechanism 301 that includes a gear 37 and a rack 38. One end of the rack 38 is bonded to the substrate of the heating member 32, and is mated with the gear 37. The rotation of the gear 37 causes the rack 38 to be moved in the horizontal direction (in the X-axis direction). In this manner, the nip adjustment mechanism 301 converts the rotational force into a force in a linear direction. The movement of the rack 38 in the horizontal direction causes the heating member bonded thereto to be also moved in the horizontal direction.

If the axis of the pressure roller 31 is located at a fixed location, the heating member 32 is moved closer to or away from the pressure roller 31 according to the rotational direction of the gear 37. Note that the nip adjustment mechanism 301 only has to move at least one of the pressure roller 31 and the heating member 32 in such a direction as to bring the one closer to or away from the other. Thus, for example, the nip adjustment mechanism 301 may also be configured such that a retainer member for holding the axis of the pressure roller 31 is moved, thereby moving the pressure roller 31 in such a direction as to bring the pressure roller 31 closer to or away from the heating member 32. As described above, the nip adjustment mechanism 301 varies the width of the nip formed by the heating member 32 and the pressure roller 31 with the endless belt 34 interposed therebetween. In other words, the nip adjustment mechanism 301 adjusts the length A (the nip width A) in the sheet conveyance direction of the interposing and pressurizing region in which the endless belt 34 is interposed under pressure between the heating member 32 and the pressure roller 31.

Furthermore, the fixing device 30 includes a temperature sensor 39 as illustrated. The temperature sensor 39 detects the surface temperature of the endless belt 34 and outputs the detection value to the controller 801.

Figure 3:
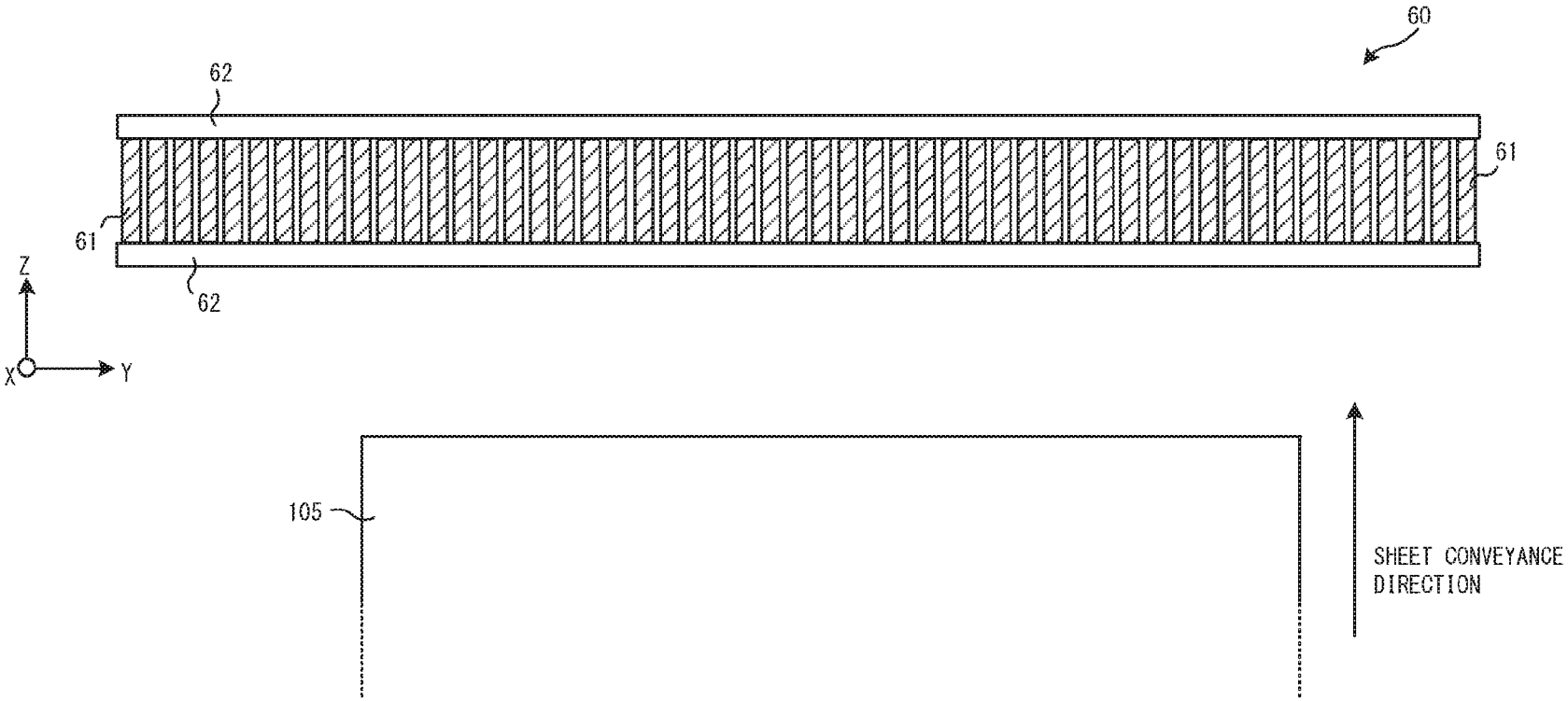
FIG. 3 is a diagram illustrating a configuration example of a heat generating resistive member according to an embodiment.

FIG. 3 illustrates a heat generating resistive member included in the heating member 32. The heat generating resistive member 60 (the heat generating element) is a plate-shaped member disposed so as to face a surface of the sheet 105 being conveyed, and configured from a plurality of resistive members 61. The resistive members 61 are a plurality of small cell regions acquired by dividing the heat generating resistive member 60 in a direction perpendicular to the sheet conveyance direction (in the Y-axis direction). Each of the resistive members 61 has both ends each connected to an electrode 62, and generates heat by energization. The electrode 62 is formed of an aluminum layer.

Although this embodiment employs the heat generating resistive member 60 divided into a plurality of smaller cells shown in FIG. 3, it is also acceptable to employ an integrated plate-shaped heat generating resistive member that has not been divided into smaller cells.

Figure 4:
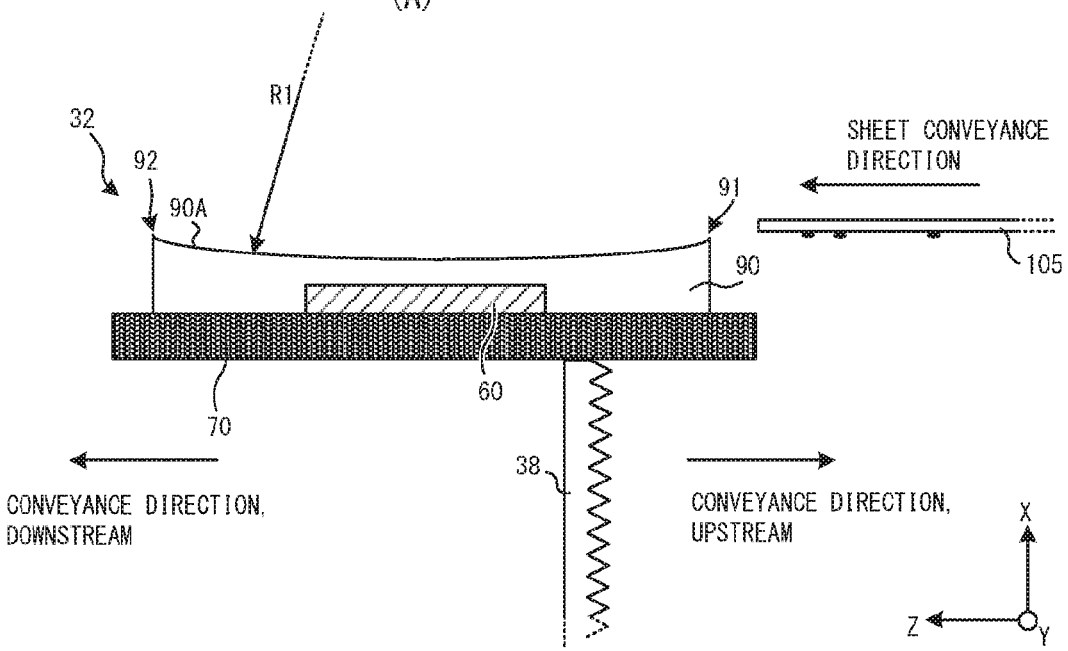
FIG. 4 is a diagram illustrating a heating member according to an embodiment and a conventional heating member.
Figure 4:
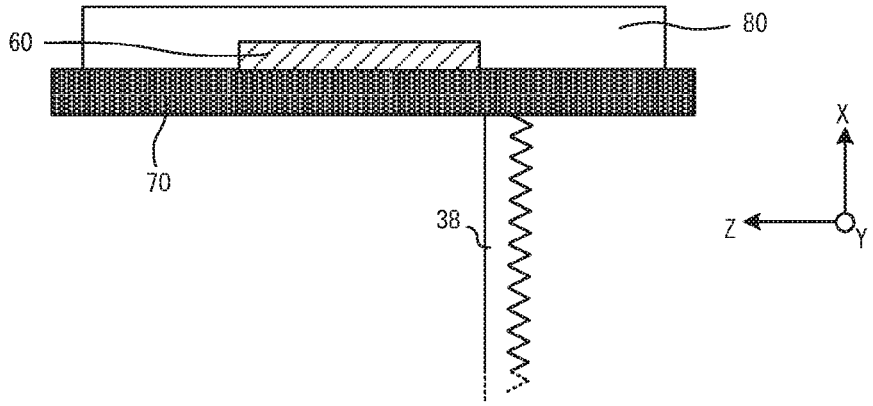

FIG. 4A illustrates the configuration of the heating member 32 according to an embodiment, and FIG. 4B illustrates the configuration of a conventional heating member for comparison purposes. In FIG. 4, the endless belt 34 and the pressure roller 31 are not shown.

The heating member 32 shown in FIG. 4A has the aforementioned heat generating resistive member 60 stacked on top of a ceramic substrate 70. Furthermore, a protective layer 90 formed from a heat-resistant member is stacked on top of the heat generating resistive member 60 so as to cover the heat generating resistive member 60. The protective layer 90 is provided to prevent the ceramic substrate 70 and the heat generating resistive member 60 from being in contact with the endless belt 34 (not shown). The provision of the protective layer 90 reduces the abrasion of the endless belt 34. In this example, the ceramic substrate 70 has a thickness of 1 to 2 mm, and the material of the protective layer 90 is $SiO_2$ with a thickness of 60 to 80 μm. The protective layer 90 is stacked on top of the ceramic substrate 70 and the heat generating resistive member 60 and brought into contact with the endless belt 34, and is longer than the heat generating resistive member 60 in the sheet conveyance direction.

The opposite surface of the ceramic substrate 70 on which the heat generating resistive member 60 is not stacked is bonded to the rack 38 as illustrated.

A surface 90A of the protective layer 90 facing the pressure roller 31 has a recessed shape (concave shape) toward the opposed pressure roller 31, and a convex curved surface toward the heat generating resistive member 60. The surface 90A of the protective layer 90 is engaged with a roller surface 31A of the pressure roller 31 and cut into such an arcuate shape as to cover, and be in contact with, the roller surface. As illustrated in FIG. 4A, the protective layer 90 is configured such that an outer part in the vicinity of ends 91 and 92 is increased in thickness (higher in the X-axis direction) and the central part is decreased in thickness (lower in the X-axis direction).

On the other hand, a conventional protective layer 80 for a heating member shown in FIG. 4B has a flat surface. The surface that is cut into an arcuate shape like the protective layer 90 of this embodiment can increase the nip width on the pressure roller 31 as compared with the protective layer 80 having the conventional flat surface shown in FIG. 4B. In this manner, the surface that is cut into an arcuate shape can ensure a predetermined nip width without increasing the weight of the pressure roller 31 and without increasing the diameter of the pressure roller 31.

Figure 5:
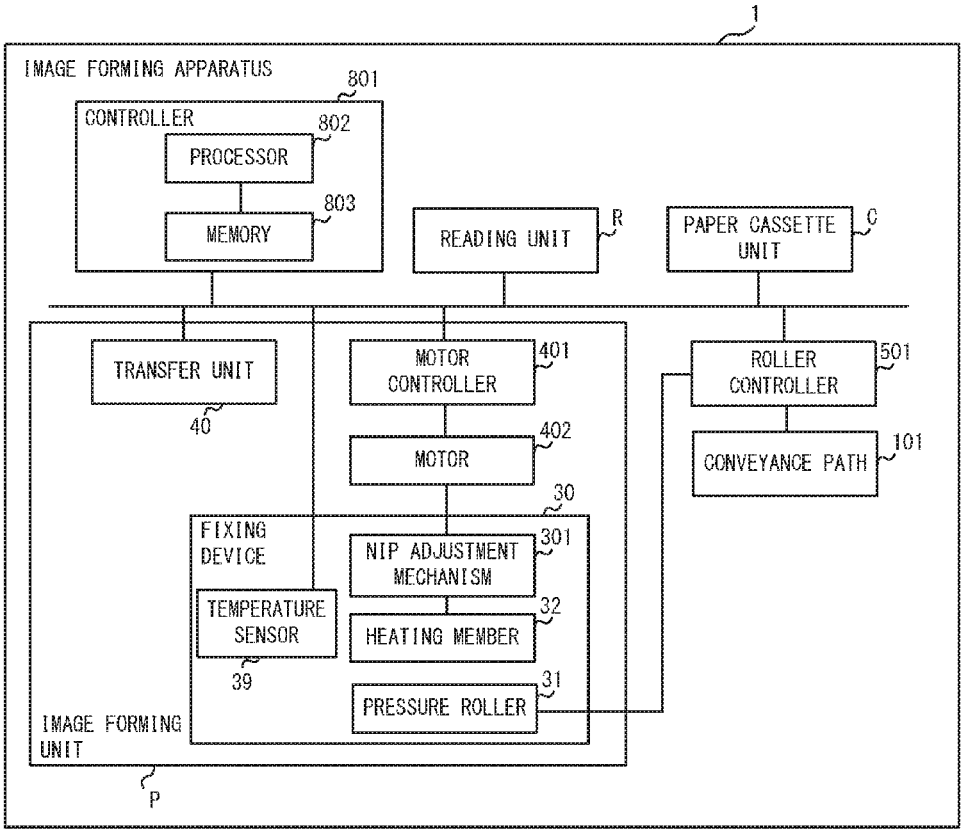
FIG. 5 is a diagram illustrating a block diagram of an image forming apparatus according to an embodiment.

FIG. 5 is a block diagram illustrating the image forming apparatus 1. The image forming apparatus 1 has the hardware configuration shown in FIGS. 1 to 4. A description will now be given of those units that have not been explained above. The controller 801 has a processor 802 and a memory 803. The processor 802 is, for example, a central processor such as a central processing unit (CPU), and the memory 803 includes volatile and nonvolatile memories for storing data or programs. As one embodiment, the processor 802 operationally executes programs stored in the memory 803, thereby allowing the controller 801 to control devices and mechanisms in the image forming apparatus 1. Alternatively, the controller 801 may implement part of the control functions as a circuit. As will be discussed later, the controller 801 performs control to adjust the nip width A during temperature raising or during a fixing process, also serving as part of the function of the fixing device 30.

A motor 402 is a stepping motor that is connected to the axis of the gear 37 of the nip adjustment mechanism 301 to rotate the gear 37. This allows the nip adjustment mechanism 301 to move the heating member 32 in the horizontal direction.

A motor controller 401 controls the drive operation of the motor 402 according to a command from the controller 801. A roller controller 501 controls the drive, stop, and the rotational speed of pairs of rollers on the conveyance path 101 and the pressure roller 31 according to a command from the controller 801.

Those other than these units shown in FIG. 5 have been already explained referring to FIGS. 1 to 4, and thus will not be repeatedly explained here.

Figure 6:
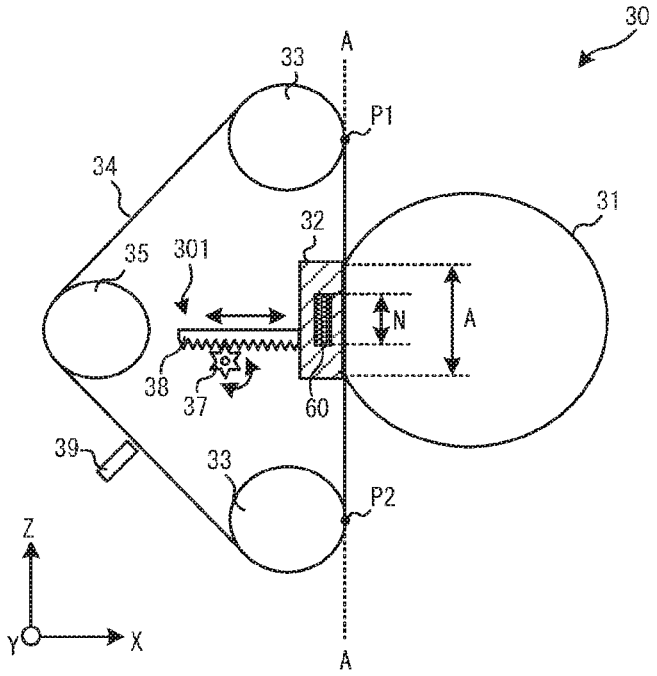
FIG. 6 is a diagram illustrating the location of the heat generating member during a fixing operation according to an embodiment, and the location of the heat generating member when a stop state is changed to an operating state.
Figure 6:
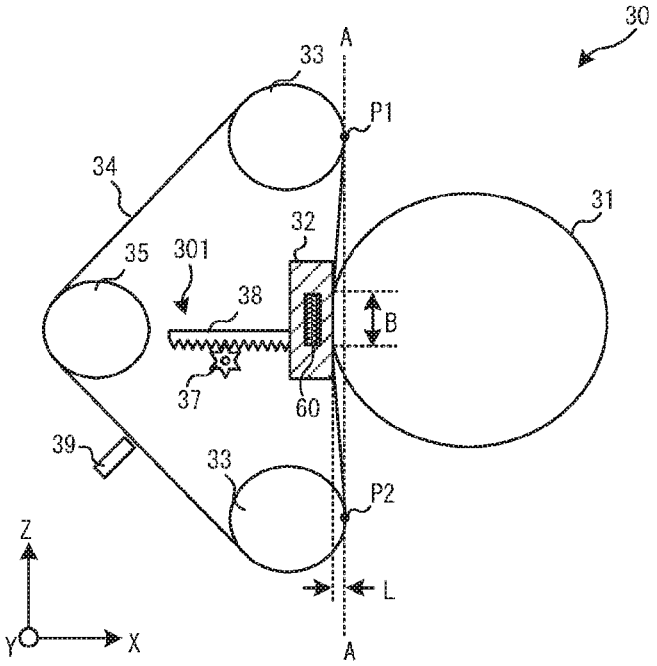

FIG. 6 is a diagram illustrating the operation for increasing or decreasing the nip width by the nip adjustment mechanism 301. The nip adjustment mechanism 301 moves the heating member 32 to two locations. The first location is a location (at which an image is fixed onto a sheet) taken when the heating member 32 performs the fixing operation, while the second location is a location (during temperature raising) taken when the heating member 32 is raised in temperature, for example, for warm-up or returning from sleep. FIG. 6(A) illustrates the location of the heating member 32 taken during the fixing operation, and FIG. 6(B) illustrates the location of the heating member 32 taken when temperature is raised.

Here, let the farthest point of each of two rollers 33 on the X-axis (the endmost point having the greatest X value) be P1 and P2, and let the line connecting between P1 and P2 be reference line A. As shown in FIG. 6(A), suppose that the surface of the heating member 32 in contact with the pressure roller 31 during the fixing operation is on the reference line A. In this case, during temperature raising, the heating member 32 is controlled by the nip adjustment mechanism 301 so as to be moved by a distance L in the minus X-axis direction. This causes the nip width during the temperature raising to be reduced as compared with the nip width A during the fixing operation. The width during temperature raising is defined as the nip width B.

Furthermore, in this embodiment, the nip width B is set to be longer than the width N of the heat generating resistive member 60 in the sheet conveyance direction. If the width N of the heat generating resistive member 60 is longer than the nip width B, the regions of the heating member 32 corresponding to the end portions in the width direction of the heat generating resistive member 60 are not in contact with the pressure roller 31. Heating the heating member 32 in this state by the heat generating resistive member 60 would cause the regions of the heating member 32 corresponding to the end portions of the heat generating resistive member 60 in the width direction to be higher in temperature as compared with the region corresponding to the heat generating resistive member 60. In this embodiment, in order to prevent such an overheated region, the length of the nip width B during temperature raising is made equal to or greater than the width N of the heat generating resistive member 60. From the foregoing, the relation below can be established:

Nip width A during fixing operation>Nip width B during temperature raising≥Width N of heat generating resistive member 60

In other words, the controller 801 performs control so that the second length B of the interposing and pressurizing region in the sheet conveyance direction during temperature raising of the heating member 32 performed before the fixing process is shorter than the first length A during the fixing process and equal to or greater than the length N of the heat generating resistive member 60 in the sheet conveyance direction. Note that the interposing and pressurizing region refers to the region in which the endless belt 34 is interposed under pressure between the heating member 32 and the pressure roller 31, and can also be called the nip width. Note that in the aforementioned embodiment, the interposing and pressurizing region was formed by the heating member 32 and the pressure roller 31. However, embodiments are not limited thereto. That is, for example, if a guide for guiding a sheet is provided upstream of the heating member, then the guide is also included as a component for forming the interposing and pressurizing region when the guide forms the interposing and pressurizing region between the guide and the pressure roller 31.

As described above, this embodiment allows the nip width formed by the heating member 32 and the pressure roller 31 to be variable. This in turn enables ensuring the nip width that can produce greater pressure during the fixing operation. On the other hand, during temperature raising, the nip width is reduced to prevent heat transfer to the pressure roller 31, so that the heating member 32 reaches a high-temperature in a shorter time.

At this time, if the nip width is reduced so excessively that the nip width B is shorter than the width N of the heat generating resistive member 60, then the regions of the heating member 32 corresponding to the end portions of the heat generating resistive member 60 in the width direction are brought into no contact with the pressure roller 31 via the endless belt 34. This leads to overheating. This in turn causes the regions of the endless belt 34 in contact with the regions of the heating member 32 to be overheated, possibly accelerating the deterioration of the endless belt 34. In this embodiment, since the nip width B during temperature raising is equal to or greater than the width N of the heat generating resistive member 60, it is possible to prevent the occurrence of a region that may be overheated by the heating member 32, thereby preventing the occurrence of a region that is overheated by the endless belt 34. Therefore, in this embodiment, it is possible to quickly raise the temperature of the heating member 32 while preventing the deterioration of the endless belt 34.

Figure 7:
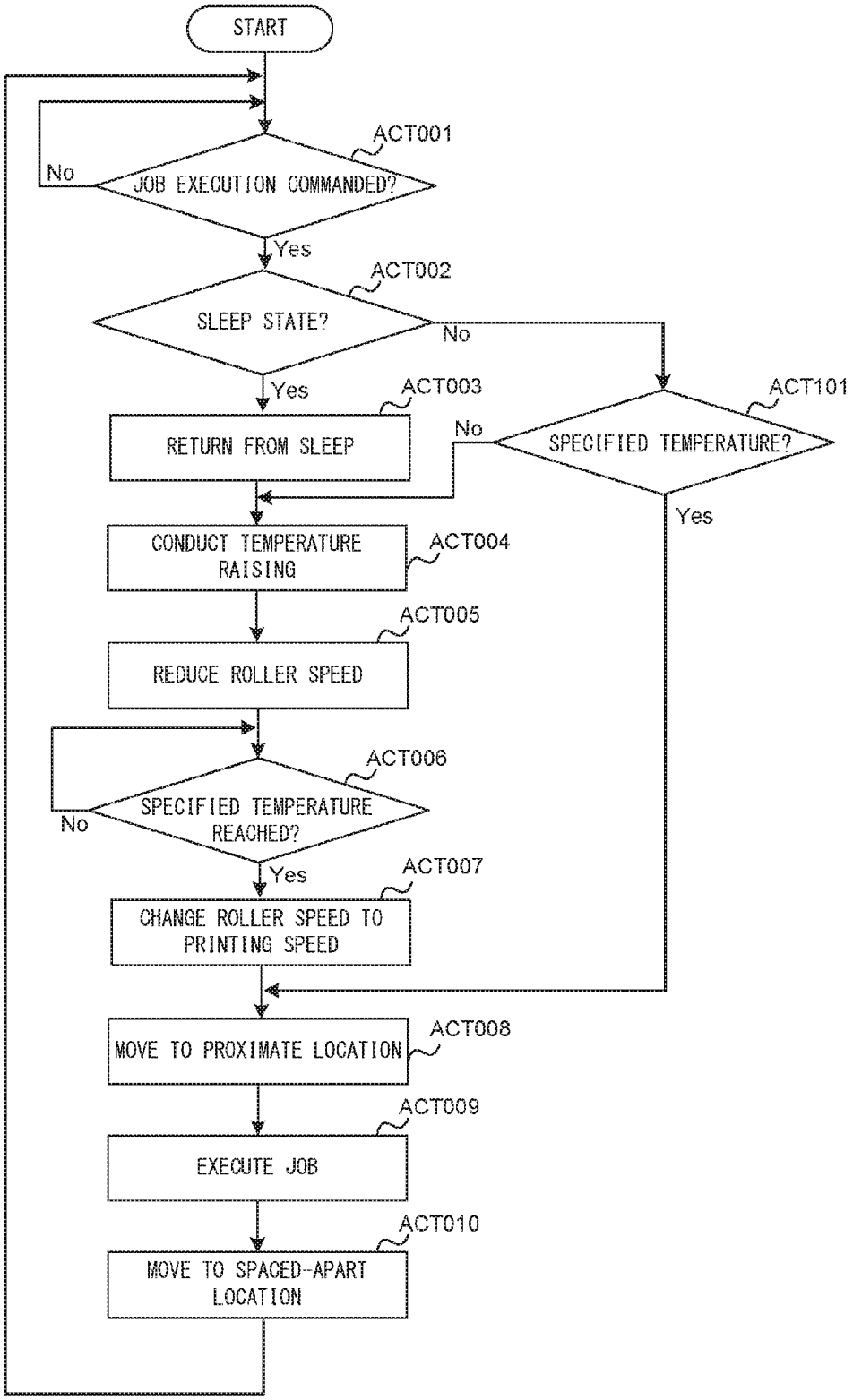
FIG. 7 is a flowchart showing an operation example according to an embodiment.

FIG. 7 is a flowchart showing an operation example of the image forming apparatus 1, and in particular, an example of control performed when the controller 801 receives a job execution. In the explanation here, the location of the heating member 32 of FIG. 6(A) is referred to as the spaced-apart location, whereas the location of FIG. 6(B) is referred to as the proximate location. Note that even though referred to as proximate or spaced-apart, the heating member 32, the endless belt 34, and the pressure roller 31 are in contact with each other in any case.

Furthermore, this embodiment assumes that the heating member 32 is at the spaced-apart location when no job is being executed. Although not illustrated in FIG. 7, it is also assumed that the transition operation of the image forming apparatus 1 from the operating state to the sleep state is performed on the basis of a conventional technique.

The controller 801 determines whether a job execution was accepted (ACT 001). It is to be understood that the job is defined herein as a job such as a print job or a copy job that requires at least the fixing device 30 to be operated for the fixing operation.

The controller 801 is on standby until the job is accepted (ACT 001—the loop of No). When the job has been accepted (ACT 001—Yes), the controller 801 determines whether the image forming apparatus 1 is in sleep mode (sleep state) (ACT 002). Note that the sleep state herein refers to a state in which the fixing device 30 is in a non-operating state, and the heating member 32 is not energized or power supply is suppressed. The sleep state also refers to a state in which the heating member 32 and the endless belt 34 have not yet reached a specified fixing temperature. In the sleep state, the controller 801 only energizes a component that may accept, for example, a print job from another device connected to a network or a touch panel for accepting a control input by a user, but interrupts energization of other components.

In the sleep state (ACT 002—Yes), the controller 801 performs mode switching control so that the image forming apparatus 1 returns from the sleep state (ACT 003). This return operation also includes the warm-up operation of the image forming apparatus 1.

In returning from the sleep state, the controller 801 performs control so that the temperature of the endless belt 34 is raised to a specified temperature (about 150° C.) (ACT 004). In ACT 004, since the heating member 32 is at the spaced-apart location, the temperature raising operation is performed with the heating member 32 located at the spaced-apart location. The temperature raising operation (temperature raising) is the process in which the temperature of the heating member 32 is raised until the temperature of the endless belt 34 is increased to one that is required for the toner to be fixed onto an ordinary sheet of paper, and is performed on returning from a power saving state such as the sleep state or at the time of turning power ON.

The controller 801 performs control so that the pressure roller 31 is reduced in speed at least during the temperature raising state (ACT 005). When the temperature raising operation is performed, the rotational speed of the pressure roller 31 and the rotational speed of the endless belt 34 are reduced to be lower than the rotational speed during the fixing process (which is defined as a normal speed), thereby reducing heat transfer to the pressure roller 31.

In this embodiment, in order to raise the temperature of the heating member 32 and the endless belt 34 to a specified temperature in a shorter time, it is necessary to reduce heat transfer to the pressure roller 31. Since lowering the rotational speed causes the contact distance between the endless belt 34 and the pressure roller 31 per unit time to be shortened (the contact area is decreased), it is possible to prevent heat from escaping from the endless belt 34 to the pressure roller 31.

The controller 801 successively checks the temperature detected by the temperature sensor 39 to determine whether the endless belt 34 (the heating member 32) has reached a specified temperature (ACT 006). When the specified temperature has been reached (ACT 006—Yes), the controller 801 performs control so that the rotational speed of the pressure roller 31 takes the normal speed (ACT 007), and allows the nip adjustment mechanism 301 to operate so that the heating member 32 is located at the proximate location (ACT 008).

Subsequently, the controller 801 executes the accepted job (ACT 009). Here, the controller 801 performs control so that the rollers on the conveyance path 101 are rotated to convey the sheet 105 to the fixing device 30, and the rotation of the pressure roller 31 is controlled so as to allow the sheet 105 to be conveyed even in the fixing device 30.

If the job has been completely executed, the controller 801 operates the nip adjustment mechanism 301 so that the heating member 32 is located at the spaced-apart location (ACT 010). In order to avoid performing the next temperature raising operation as located at the proximate location on returning from the sleep state, the controller 801 moves the heating member 32 to the spaced-apart location at this timing. During the sleep state, since the controller 801 is not operated and thus cannot output a command to move the heating member 32, this embodiment is configured such that the heating member 32 is moved in advance to the spaced-apart location while the heating member 32 can be moved. Note that when returning from the sleep state, it is also acceptable to move the heating member 32 from the proximate location to the spaced-apart location.

After the movement to the spaced-apart location, the controller 801 is on standby until the next job is accepted (returns to ACT 001).

Now, a description will be made back to ACT 002. In the determination of ACT 002, in no sleep state (ACT 002—No), the controller 801 acquires a detected temperature from the temperature sensor 39 to determine whether the endless belt 34 has reached a specified temperature (ACT 101). Here, when the specified temperature has not yet been reached (ACT 101—No), the process proceeds to ACT 004. When the specified temperature has been reached (ACT 101—Yes), the process proceeds to ACT 008. As described above, when the endless belt 34 is at a low temperature, the operations of ACT 004 to ACT 007 and ACT 008 are performed. That is, at the time of a ready state, the controller 801 performs temperature control to the heating member 32 so that the heating member 32 (the endless belt 34) reaches a target temperature. However, at this time when the heating member 32 (the endless belt 34) is at a low temperature, the controller 801 performs processes ACT 004 to ACT 006 in which the nip width is reduced than during the fixing process to raise the temperature of the heating member 32. In the ready state, the controller 801 does not execute the print job, but performs temperature control to energize the heating member 32 and raise the temperature of the heating member 32 to the target temperature so that the print job can be executed immediately when the print job is accepted.

In the aforementioned embodiment, a description was given of the operations at the time of returning from sleep or warming-up by way of example. However, aspects are not limited thereto. The embodiment is also applicable to the time of turning power ON of the image forming apparatus 1. In other words, while the heating member 32 is being increased in temperature, the nip adjustment mechanism 301 performs control such that the nip width is shorter than during the fixing operation. On the other hand, in the aforementioned embodiment, while the heating member 32 is being increased in temperature, the rotational speed of the pressure roller 31 is controlled so as to be lower than during the fixing operation.

Furthermore, in the aforementioned embodiment, a description was given of the case where when the fixing device is changed from the non-operating state to the operating state, the nip width is shorter than during the fixing operation. As used herein, the operating state refers to the state in which the fixing device can perform the fixing operation. As also used herein, the non-operating state refers to a state in which the fixing device has no fixing function, for example, a low-power state or a non-energized state.

A description was given of such an implementation example in which the nip adjustment mechanism 301, having the gear 37 and the rack 38, performs rotational control to the gear 37 to thereby vary the nip width. The configuration of the nip adjustment mechanism 301 may also be other than that. For example, it is also acceptable to employ such an implementation that is provided with an elastic body such as a spring in order to utilize the biasing of the elastic body.

Furthermore, in the aforementioned embodiment, a description was given assuming that the heating member 32 is moved to thereby vary the nip width. However, aspects are not limited thereto. The pressure roller 31 may be moved to vary the nip width, or both the heating member 32 and the pressure roller 31 may also be moved to vary the nip width. Note that since the pressure roller 31 acts as a driving source, the pressure roller 31 may be better made stationary to stabilize the entire structure of the apparatus.

The temperature sensor 39 may also be provided in the vicinity of the heating member 32 in order to directly measure the temperature of the heating member 32.

Second Embodiment

Figure 8:
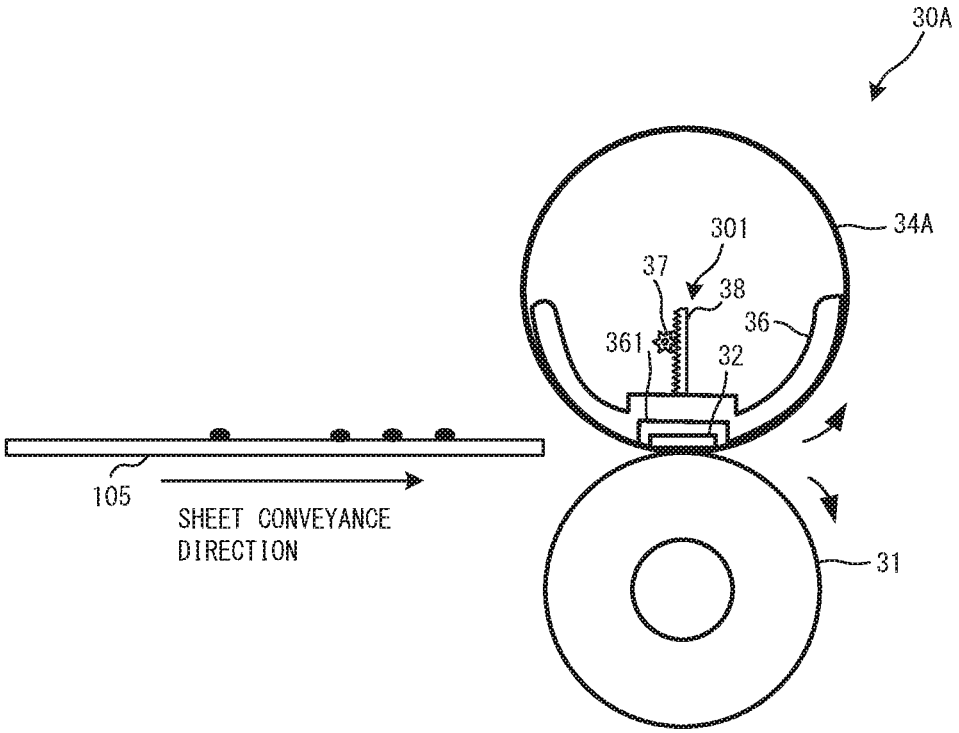
FIG. 8 is a diagram illustrating a fixing device according to a second embodiment.

In a second embodiment, a description will be given of an example of an aspect for which the configuration of the fixing device according to the first embodiment has been changed. FIG. 8 is a diagram illustrating a configuration example of a fixing device 30A.

A film guide 36 is semi-cylindrical and accommodates the heating member 32 in a recessed portion 361 on the outer circumferential surface.

A fixing film 34A (belt) is an endless rotational belt. The fixing film 34A is fitted over the outer circumferential surface of the film guide 36. The fixing film 34A is interposed and held between the film guide 36 and the pressure roller 31 and driven by the rotation of the pressure roller 31.

The aforementioned heating member 32 is in contact with the fixing film 34A and heats the fixing film 34A.

A sheet 105 on which a toner image is formed is conveyed between the fixing film 34A and the pressure roller 31. The fixing film 34A heats the sheet and fixes the toner image on the sheet onto the sheet.

The aspect of the heating member 32 according to the first embodiment can also be applied to the fixing device 30A of the second embodiment. That is, the heating member 32 has the heat generating resistive member 60 therein.

In this embodiment, the rack 38 is bonded to the film guide 36. The controller 801 allows the nip adjustment mechanism 301 to bring the film guide 36 closer to or away from the pressure roller 31. The controller 801 performs control so that the second length of the interposing and pressurizing region in the sheet conveyance direction during the temperature raising of the heating member 32 (the fixing film 34A) is shorter than the first length during the fixing process and equal to or greater than the length of the heat generating resistive member 60 in the sheet conveyance direction.

In this embodiment, a temperature sensor (not shown) directly measures the temperature of the heating member 32. The temperature sensor may also be a contact type sensor, which may include, for example, a film-shaped thermistor inserted in between the fixing film 34A and the heating member 32. Furthermore, the temperature sensor may also be provided on the surface of the film guide 36 bonded to the rack 38 so as to measure the temperature of the heating member 32 in a non-contact manner.

As described in detail above, this embodiment makes it possible to reduce unnecessary heat transfer to the pressure roller and shorten the time for the fixing device to return from the stop state to the operating state.

While certain embodiments have been described, these embodiments have been presented by way of example only, and are not intended to limit the scope of invention. Indeed, the novel apparatus, methods and system described herein may be embodied in a variety of other forms; furthermore, various omissions, substitutions and changes in the form of the apparatus, methods and system described herein may be made without departing from the spirit of the inventions. The accompanying claims and their equivalents are intended to cover such forms or modifications as would fall within the scope and spirit of the inventions.

What is claimed is:

1. A fixing device comprising:

an endless belt;

a pressure element configured to convey and press a sheet while interposing the sheet under pressure between the pressure element and the endless belt;

a heating member provided on an inner side of the endless belt and having a heat generating element configured to heat the endless belt;

an adjustment mechanism configured to move at least one of the heating member and the pressure element in such a direction as to bring the one closer to or away from the other so as to adjust a nip width which is a length of an interposing and pressurizing region in a sheet conveyance direction, the interposing and pressurizing region being formed by the heating member and the pressure element to interpose the endless belt under pressure; and a controller configured to control the adjustment mechanism so that $A>B\geq N$ is satisfied, where A is a nip width during a fixing process in which the sheet is heated to fix a toner image onto the sheet, B is a nip width during temperature raising of the heating member to be conducted before the fixing process, and N is a length of the heat generating element in the sheet conveyance direction.

2. The fixing device according to claim 1, wherein the heating member comprises: a substrate; the heat generating element stacked on top of the substrate; and a protective layer which is stacked on top of the substrate and the heat generating element and which is longer than the heat generating element in the sheet conveyance direction.

3. The fixing device according to claim 1, further comprising a temperature detection unit configured to detect a surface temperature of the endless belt, wherein the controller configured to control the adjustment mechanism so that the nip width is B and the heat generating element raises the temperature of the heating member when a temperature detected by the temperature detection unit is below a specified value in a standby state for the fixing process and temperature control of the endless belt.

4. The fixing device according to claim 1, wherein the controller configured to control a rotational speed of the pressure element so that the speed during the temperature raising is lower than the speed during the fixing process.

5. An image forming apparatus comprising:

a transfer unit configured to transfer an image onto a sheet; and a fixing device configured to fix a transferred image onto the sheet, the fixing device being provided with:

an endless belt;

a pressure element configured to convey the sheet while interposing the sheet under pressure between the pressure element and the endless belt;

a heating member provided on an inner side of the endless belt and having a heat generating element configured to heat the endless belt;

an adjustment mechanism configured to move at least one of the heating member and the pressure element in such a direction as to bring the one closer to or away from the other so as to adjust a nip width which is a length of an interposing and pressurizing region in a sheet conveyance direction, the interposing and pressurizing region being formed by the heating member and the pressure element to interpose the endless belt under pressure; and a controller configured to control the adjustment mechanism so that $A>B\geq N$ is satisfied, where A is a nip width during a fixing process in which the sheet is heated to fix a toner image onto the sheet, B is a nip width during temperature raising of the heating member to be conducted before the fixing process, and N is a length of the heat generating element in the sheet conveyance direction.

6. The image forming apparatus according to claim 5, wherein the heating member comprises: a substrate; the heat generating element stacked on top of the substrate; and a protective layer which is stacked on top of the substrate and the heat generating element and which is longer than the heat generating element in the sheet conveyance direction.

7. An adjustment method for a nip width which is the length of an interposing and pressurizing region in a sheet conveyance direction by a fixing device, the fixing device having an endless belt, a pressure element configured to convey and press a sheet while interposing the sheet under pressure between the pressure element and the endless belt, and a heating member provided on an inner side of the endless belt and having a heat generating element configured to heat the endless belt, the fixing device having the interposing and pressurizing region formed by the heating member and the pressure element to interpose the endless belt under pressure, the method comprising:

moving at least one of the heating member and the pressure element in such a direction as to bring the one closer to or away from the other during temperature raising of the heating member to be conducted before a fixing process in which the sheet is heated to fix a toner image onto the sheet; and controlling at least one of the heating member and the pressure element such that A>B≥N is satisfied, where A is a nip width during the fixing process, B is a nip width during the temperature raising, and N is a length of the heat generating element in the sheet conveyance direction.

8. The adjustment method according to claim 7, wherein the heating member comprises: a substrate; the heat generating element stacked on top of the substrate; and a protective layer which is stacked on top of the substrate and the heat generating element and which is longer than the heat generating element in the sheet conveyance direction.

9. The adjustment method according to claim 7, wherein the fixing device further has a temperature detection unit configured to detect a surface temperature of the endless belt, and controlling at least one of the heating member and the pressure element so that the nip width is B and the heat generating element raises the temperature of the heating member when a temperature detected by the temperature detection unit is below a specified value in a standby state for the fixing process and temperature control of the endless belt.

10. The adjustment method according to claim 7, wherein Controlling a rotational speed of the pressure element such that the speed during the temperature raising is lower than the speed during the fixing process.

* * * * *